US007434791B2

(12) United States Patent
Weon

(10) Patent No.: US 7,434,791 B2
(45) Date of Patent: Oct. 14, 2008

(54) FAUCET-BASED HUMIDIFIER

(76) Inventor: Yoo Sung Weon, 11305 Elk Run Rd., Catlett, VA (US) 20119

( * ) Notice: Subject to any disclaimer, the term of this patent is extended or adjusted under 35 U.S.C. 154(b) by 0 days.

(21) Appl. No.: 11/015,790

(22) Filed: Dec. 20, 2004

(65) Prior Publication Data

US 2006/0131764 A1 Jun. 22, 2006

(51) Int. Cl.
*B01F 3/04* (2006.01)

(52) U.S. Cl. ..... 261/30; 261/81; 261/DIG. 46; 261/DIG. 48

(58) Field of Classification Search ..... 261/72.1, 261/81, 84, 119.1, DIG. 15, DIG. 46, DIG. 48, 261/DIG. 65, 30, 66
See application file for complete search history.

(56) References Cited

U.S. PATENT DOCUMENTS 3,823,922 A * 7/1974 McElreath ..... 261/92
3,860,401 A * 1/1975 Clark et al. ..... 95/198
3,952,181 A * 4/1976 Reed ..... 392/397
5,300,260 A * 4/1994 Keshet et al. ..... 261/81
5,407,604 A * 4/1995 Luffman ..... 261/4
5,447,663 A * 9/1995 Dix et al. ..... 261/70
5,693,266 A * 12/1997 Jung ..... 261/142
5,855,823 A * 1/1999 MacGibbon et al. ..... 261/142
6,244,576 B1 * 6/2001 Tsai ..... 261/141
2005/0212152 A1 * 9/2005 Reens ..... 261/81

* cited by examiner

*Primary Examiner*—Scott Bushey
(74) *Attorney, Agent, or Firm*—Venable LLP; Raymond J. Ho

(57) ABSTRACT

A humidifier adapted to be connected directly to a faucet, thereby eliminating the need for a water storage container. The humidifier has a main body, vibrator, pipe, fan, air tunnel, drain pipe, and power source. The main body, which includes openings at different height, has a top, bottom, and sides for defining interior and exterior portions. The vibrator and pipe, which transports water from a faucet to the main body, are both secured to the main body. The fan is electrically powered by the power source and produces air flow. One side of the air tunnel allows air flow produced by the fan to enter, while the other side is connected to the main body.

16 Claims, 2 Drawing Sheets

FAUCET-BASED HUMIDIFIER

BACKGROUND OF THE INVENTION

1. Field of the Invention

The present invention relates to a humidifier with no reservoir. More specifically, it relates to a faucet-based humidifier that connects directly to a faucet, thereby eliminating the need for a removable water storage container or reservoir.

2. Description of Related Art

There are currently a variety of humidifiers being utilized and proposed. The beneficial effects of these humidifiers are numerous and include: protection of the respiratory system of the user, reducing dryness and irritation in the user's nose and throat, reduction in static electricity, and protection of wood furniture, paneling and fabrics. An important factor in the design of these systems is the need for a water container to provide the source of moisture to be added to the air.

In the related art, various types of humidifiers have been proposed.

For example, U.S. Pat. No. 5,447,663 to Dix. et al., discloses a floor mounted humidifier having a wheel mounted water reservoir tank.

U.S. Pat. No. 5,792,390 to Marino discloses a portable humidifier having an improved top filled water tank having a fill hole sealed by a snap plug assembly.

U.S. Pat. No. 5,482,190 to Stanek, et al., discloses a combined filling trough trough/dispensing cap primarily constructed for use with a removable bottle or water reservoir tank to facilitate filling and dispensing of the liquid contents of the container or tank.

U.S. Pat. No. 5,480,588 to Tomasiak, et al., discloses a humidifier with exposed spaced water bottles which are constructed to facilitate filling and carrying of the humidifier.

While these humidifier systems accomplish their intended purpose of adding moisture to air, they suffer from a number of drawbacks. For example, they typically require one or more water storage containers. Since the water containers provide the humidifier with the required moisture to be added to the air, they become empty after a period of use, and must be refilled by the user. This situation can be awkward and unnecessarily burdensome. In particular, conventional humidifiers, being prohibited from extended operation without user intervention, are not capable of autonomous, standalone operation.

In order to overcome these problems, what is needed is a humidifier which does not require human intervention for extended operations, and in particular does not require user intervention to refill water storage container(s), thus addressing and solving problems associated with conventional systems.

SUMMARY OF THE INVENTION

To be capable of being connected directly to a faucet, thereby eliminating the need for a water storage container, the humidifier has a main body, vibrator, pipe, fan, air tunnel, drain pipe, and power source. Specifically, the main body, which includes openings at different height, has a top, bottom, and sides for defining interior and exterior portions. The vibrator is secured to the main body, and the pipe transports water from a faucet to the main body. The fan is electrically powered by the power source and produces air flow. One side of the air tunnel allows air flow produced by the fan to enter, while the other side is connected to the main body.

Accordingly, it is an object of the invention disclosed herein to provide a new and improved humidifier, which uses a unique design which allows water to be provided to the humidifier via the attachment of a water faucet to the humidifier, thereby eliminating the need for refilling water containers.

It is another object of the invention disclosed herein to provide a new and improved humidifier which prevents bacteria and related build-up in the machine.

It is a further object of the invention disclosed herein to provide a new and improved humidifier which cleans the surrounding air when drained periodically or constantly.

These and other objects and advantages of the present invention will be fully apparent from the following description, when taken in connection with the annexed drawings.

BRIEF DESCRIPTION OF THE DRAWINGS

The teachings of the present invention can be readily understood by considering the following detailed description in conjunction with the accompanying drawings, in which.

DETAILED DESCRIPTION OF AN EXEMPLARY EMBODIMENT

Figure 1:
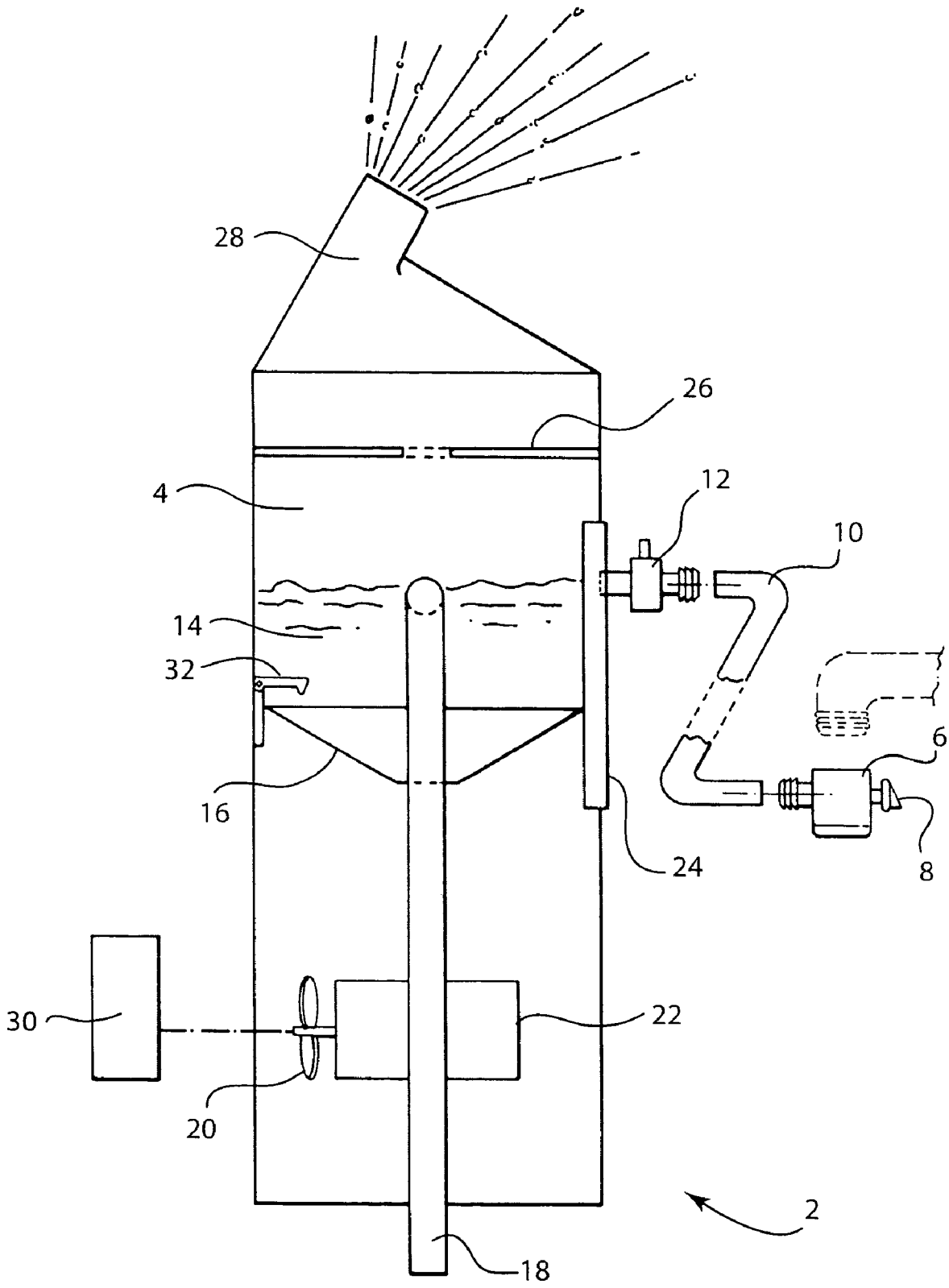
FIG. 1 depicts a perspective view of a humidifier according to the principles of the present application.
Figure 2:
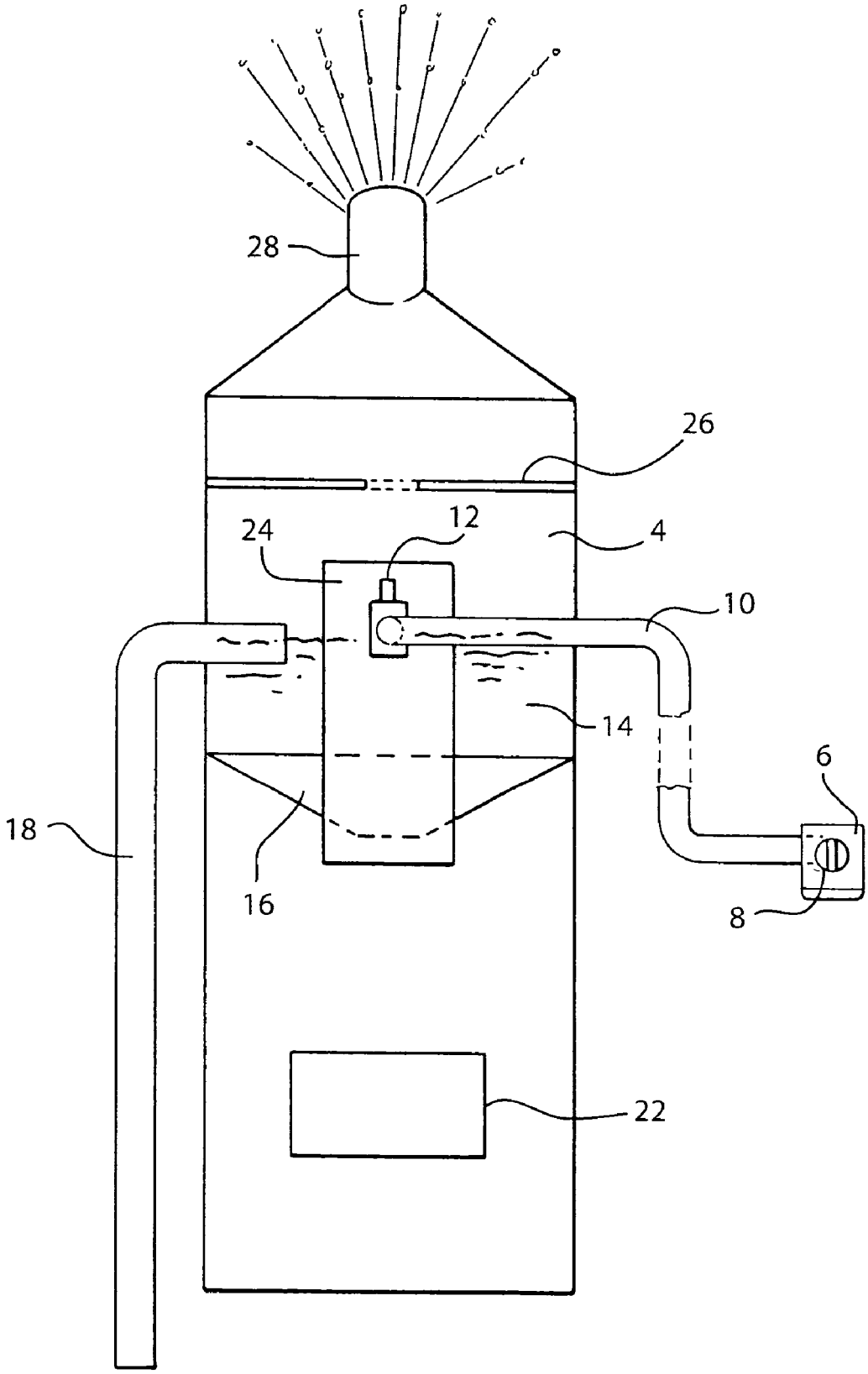
FIG. 2 depicts a side view of a humidifier according to the principles of the present application.

Referring now to the drawings in greater detail, in which similar or corresponding parts are identified with the same reference numeral, FIG. 1 shows a perspective frontal view of a humidifier 2 according to an exemplary embodiment of the present invention. Central to FIG. 1 is a main body 4 of the humidifier 2. A connector 6 is connected to an external water faucet for water intake into the humidifier 2. The connector 6 may be a threaded screw-type attachment which screws onto the external water faucet. A water director 8 has an adjustable valve (not shown) and is inserted into an opening of the connector 6. The water director 8 is well known in the art, and has been used in, for example, water purifiers.

A pipe 10 transports water from the external water faucet into the humidifier 2. The Pipe 10 can be of variable length, and can be rigid, flexible, or can consist of a combination of rigid sections and flexible sections. For instance, a pipe that is short and rigid can be used when the humidifier 2 is to be placed a short distance from a faucet. Conversely, a longer pipe with a flexible section can be used when placement of the humidifier at a longer distance from the external water faucet is required. In other words, the humidifier 2 can be placed at any convenient distance from the external water faucet.

FIG. 1 also shows that a control valve 12 is mounted onto the pipe 10, with the control valve 12 being adjustable and controlling the water flow rate through the pipe 10 and into the humidifier 2. The control valve 12 can be any of a number of conventional water flow rate control valves. For example, a conventional water shut-off valve can be used as the control valve 12.

The Pipe 10 is attached to an opening of the main body 4, and allows water to flow into a water basin 14. The water basin 14 is defined by the interior of the walls of the main body 4 of the humidifier 2, and the bottom of the water basin 14 has a vibrating unit 16 affixed therein.

The vibrating unit 16 can be of a conical shape, and made from a flexible material. The vibrating unit 16 undergoes a pulsating motion when connected to a suitable power source. This may be accomplished by connecting vibrating unit 16 to magnetic induction device, as in a conventional speaker system. Alternatively, vibrating unit 16 may be connected to a motor. By vibrating at a high frequency, the vibrating unit 16 pulverizes or transforms water into vapors or small droplets.

A drain pipe 18 is attached to one of the walls of the main body 4 at a space that is higher than the vibrating unit 16. The drain pipe 18 drains excess water from the basin 14 as to maintain a water level in the basin 14 at approximately the same level as that of the drain pipe 18. The drain pipe 18 is preferably located at a lower or approximately same vertical height as that of the opening of the pipe 10 so that constant flushing of water in the water basin 14 can be maintained irrespective of whether the vibrating unit 16 is activated.

Air is directed into the humidifier 2 via a fan 20. The fan 20 shown in FIG. 1 is merely a schematic description, and therefore a more detailed depiction may include, e.g., housing and electrical components. Thereafter, the air flow contacts and cools electrical components 22 and continues to flow into the air tunnel 24. The air tunnel has an opening at its bottom, into which air flows, and is oriented generally vertically and directs air upwards. The air tunnel 24 also has an opening at the top which directs the air flow into the main body 4 of the humidifier 2, and thereby in direct contact with the vapors or small droplets of water. The vapors or small droplets of water are transported via the air flow and directed upwards through the main body 4.

The upward flow of now-humidified air may be focused through an optional air director 26, which is disposed inside the main body. Air director 26 can be made from a thin material, and attached to the sides of the main body 4. By having one or more holes in the air director 26, air flow can be circulated inside main body 4, mixed with vapors or small droplets, and directed or focused upward. Through an optional air direction controller 28, the air flow may exit the humidifier 2 in the form of a directed mist.

A power source 30, which can include a transformer, electrical cord, and plug to be mated with a conventional electrical receptacle (not shown), provides and suitably transforms electrical power for the humidifier 2. Alternately, or in combination, humidifier 2 may be powered by a battery of sufficient voltage.

Optionally, a water level sensor 32 can be mounted to the interior of the walls of the main body 4. The water level sensor 32 is placed at a height at which the vibrator 16 can operate safely with minimum water. However, in order for sufficient water to be stably present in the interior of humidifier 2, the height of the water level sensor should be lower than the height of drain pipe 18.

The water level sensor 32 acts as a switch to cut off power to the electrical components 22 when low water level is detected. For instance, when the water level is at or above the water level sensor 32, the water causes the completion of an electrical connection from the sensor 32 to the vibrating unit 16 via electrical components 22. Therefore, the addition of the water level sensor 32 prohibits the humidifier 2 to be operated when insufficient water is present. The inclusion of the water level senor 32 has the advantages of (1) preventing operation of humidifier 2, and the consequent wastage of power and poor humidification, when insufficient water is present; and (2) preventing possible overheating and potential damage to vibrator 16 and the associated electrical components when operated without sufficient water.

Operation

To prepare the humidifier for use, the user attaches the connector 6 to the end of the external water faucet. The attachment may be according to a number of conventional means, for example by a threaded screw. The user also turns on the power source by connecting, for instance, an electrical plug to the appropriate electrical receptacle.

In order to use the present invention, the user turns on the external water faucet, allowing water to flow into the connector 6. The water director 8 is set to a position which allows water to flow into the pipe 10, although at any time the water director 8 may be set to a closed position, allowing water to flow from the external water faucet into a sink, as if the humidifier were not present. This feature permits normal use of the sink without requiring disconnection of the humidifier 2.

The water then flows through the pipe 10 and into the basin 14, thereby contacting the vibrating unit 16. If the optional water level sensor 32 is mounted, the humidifier shuts down when the water level falls to a predetermined level. If the optional water level sensor 32 is not included, then the user powers the vibrating unit 16 through use of an on/off switch (not shown). The water flow rate can be adjusted to a desirable level through the use of water pressure control valve 12, and direction of the mist can be changed via the air direction controller 28.

The humidifier 2 as shown in FIG. 1 has the capability to run for an extended period without needing or requiring cleaning. Since the source of water is continuously running, there is also no stagnant water in which bacteria may grow. Additionally, ambient air is cleaned by recycling action through the humidifier 2.

Water can be redirected away from the humidifier 2 if such is needed humidifier can be turned off by disconnecting the external water faucet and the electrical plug. for other purposes, such as washing, by adjusting the water director 8. The Although the humidifier of the present application has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What is claimed is:

1. A humidifier adapted to be connected to a faucet, said humidifier comprising:

a main body having a top, bottom, and sides connecting said top to said bottom, said sides defining an interior portion and an exterior portion;

said main body having a vibrator secured thereto to form a basin therein;

a water passage for transporting water from a faucet to said main body, said water passage having a first end and a second end, and said water passage having a first connector on said first end for connecting to a faucet; and said water passage having a second connector on said second end for connecting to a first opening in said main body;

a fan, being electrically powered and producing air flow;

an air tunnel, having a first end and a second end, said first end allowing air flow produced by said fan to enter said air tunnel, and said second end being connected to a second opening in said main body;

a drain pipe, being connected to a third opening in said main body, said third opening being at a height less than that of said second opening and greater than that of said vibrator; and a power source for providing electrical power to said humidifier, wherein said third opening for said drain pipe is at a same or lower vertical height than said first opening for said water passage in order to maintain constant flushing of said water in said basin of said main body.

2. The humidifier of claim 1, further comprising a focusing means for focusing air flow inside the main body.

3. The humidifier of claim 1, further comprising a directing means for directing humidified air upon exit from the humidifier.

4. The humidifier of claim 1, wherein said water passage comprises a pipe.

5. The humidifier of claim 4, wherein said pipe is rigid.

6. The humidifier of claim 4, wherein said pipe has at least one section which is flexible.

7. The humidifier of claim 1, further comprising a control valve, wherein said control valve regulates the water flow from the faucet through said water passage to said main body.

8. The humidifier of claim 1, further comprising a water level sensor, wherein said water level sensor is located on the interior of said main body, at a height lower than that of said third opening, so that when the water level reaches the height of said water level sensor, power is transferred to said vibrator.

9. A humidifier adapted to be connected to a faucet, said humidifier comprising:

a main body having a top, bottom, and sides connecting said top to said bottom, said sides defining an interior portion and an exterior portion;

said main body having a vibrator secured thereto to form a basin therein;

a water passage for transporting water from a faucet to said main body, said water passage having a first end and a second end, and said water passage having a first connector on said first end for connecting to a faucet; and said water passage having a second connector on said second end for connecting to a first opening in said main body;

a control valve, regulating the water flow from the faucet through said water passage to said main body;

a fan, being electrically powered and producing air flow;

an air tunnel, having a first end and a second end, said first end allowing air flow produced by said fan to enter said air tunnel, and said second end being connected to a second opening in said main body;

a drain pipe, connected to a third opening in said main body, said third opening being at a height less than that of said second opening and greater than that of said vibrator; and a power source for providing electrical power to said humidifier, wherein said third opening for said drain pipe is at a same or lower vertical height than said first opening for said water passage in order to maintain constant flushing of said water in said basin of said main body.

10. The humidifier of claim 9, further comprising a focusing means for focusing air flow inside the main body.

11. The humidifier of claim 9, further comprising a directing means for directing humidified air upon exit from the humidifier.

12. The humidifier of claim 9, wherein said water passage comprises a pipe.

13. The humidifier of claim 12, wherein said pipe is rigid.

14. The humidifier of claim 12, wherein said pipe has at least one section which is flexible.

15. The humidifier of claim 9, further comprising a water director, said water director having a first position directing the water flow from the faucet to said water passage and a second position directing the water flow from the faucet to an alternative destination.

16. The humidifier of claim 9, further comprising a water level sensor, wherein said water level sensor is located on the interior of said main body, at a height lower than that of said third opening, so that when the water level reaches the height of said water level sensor, power is transferred to said vibrator.

* * * * *